US008522388B2

(12) United States Patent
Jiang et al.

(10) Patent No.: US 8,522,388 B2
(45) Date of Patent: Sep. 3, 2013

(54) SELF-WRINGING MOP

(75) Inventors: Weilai Jiang, Shanghai (CN); Feng Zeng, Shanghai (CN); Jian Jun Peng, Shanghai (CN)

(73) Assignee: 3M Innovative Properties Company, Saint Paul, MN (US)

( * ) Notice: Subject to any disclaimer, the term of this patent is extended or adjusted under 35 U.S.C. 154(b) by 316 days.

(21) Appl. No.: 12/865,179

(22) PCT Filed: Jan. 28, 2009

(86) PCT No.: PCT/US2009/032225

§ 371 (c)(1),
(2), (4) Date: Nov. 19, 2010

(87) PCT Pub. No.: WO2009/097326

PCT Pub. Date: Aug. 6, 2009

(65) Prior Publication Data

US 2011/0047733 A1 Mar. 3, 2011

(30) Foreign Application Priority Data

Jan. 29, 2008 (CN) ..... 2008 1 0008772

(51) Int. Cl.
*A47L 13/144* (2006.01)

(52) U.S. Cl.
USPC ..... 15/119.2; 15/119.1; 15/116.2

(58) Field of Classification Search
USPC ..... 15/119.1, 119.2, 116.1, 116.2, 230.14
See application file for complete search history.

(56) References Cited

U.S. PATENT DOCUMENTS

| | | | | | |
|---|---|---|---|---|---|
| 1,855,218 | A | * | 4/1932 | Cyrill | 15/119.2 |
| 2,073,726 | A | * | 3/1937 | Bates | 15/119.2 |
| 2,194,150 | A | * | 3/1940 | Price | 15/119.2 |
| 2,651,069 | A | * | 9/1953 | Hoffman | 15/119.2 |
| 2,653,337 | A | * | 9/1953 | Bathurst | 15/119.2 |
| 2,695,417 | A | * | 11/1954 | Bathurst | 15/119.2 |
| 2,794,198 | A | * | 6/1957 | Rogers | 15/119.2 |
| 2,873,462 | A | * | 2/1959 | Green | 15/119.2 |
| 3,253,290 | A | * | 5/1966 | Powers | 15/119.2 |
| 3,345,667 | A | * | 10/1967 | Josef | 15/119.2 |
| 4,333,198 | A | * | 6/1982 | Vosbikian | 15/119.2 |
| 4,481,688 | A | * | 11/1984 | Graham | 15/119.2 |
| 4,491,998 | A | * | 1/1985 | Wilson et al. | 15/119.2 |
| 4,516,287 | A | * | 5/1985 | Johnson et al. | 15/119.2 |
| 4,875,246 | A | * | 10/1989 | MacGregor | 15/98 |

(Continued)

FOREIGN PATENT DOCUMENTS

| | | |
|---|---|---|
| CN | 2778187 | 5/2006 |
| CN | 2882514 | 3/2007 |

(Continued)

OTHER PUBLICATIONS

PCT International Search Report PCT/ISA/210.

*Primary Examiner* — Lee D Wilson
*Assistant Examiner* — Joel Crandall
(74) *Attorney, Agent, or Firm* — Trisha D. Adamson

(57) ABSTRACT

A self-wringing mop is disclosed that comprises a handle, a mounting support forming an axis of rotation, wherein the mounting support is connected with the handle, a cleaning portion connected with the mounting support in such a manner that the cleaning portion is rotatable about the axis, and a pressing member connected with the handle, wherein the pressing member engages with the cleaning portion to inhibit rotation of the cleaning portion.

13 Claims, 5 Drawing Sheets

(56) References Cited

U.S. PATENT DOCUMENTS

| | | | | | |
|---|---|---|---|---|---|
| 5,097,561 | A | * | 3/1992 | Torres | 15/119.2 |
| 5,331,706 | A | * | 7/1994 | Graham | 15/119.2 |
| RE35,005 | E | * | 8/1995 | Torres | 15/119.1 |
| 5,528,791 | A | * | 6/1996 | Wilson | 15/119.2 |
| 5,887,309 | A | * | 3/1999 | Lin | 15/119.2 |
| 5,933,904 | A | * | 8/1999 | De Guzman | 15/119.2 |
| 5,974,617 | A | * | 11/1999 | Chang | 15/119.2 |
| 6,026,530 | A | * | 2/2000 | Camp, Jr. | 15/119.2 |
| 6,032,318 | A | * | 3/2000 | McLaughlin et al. | 15/228 |
| 6,055,696 | A | * | 5/2000 | Lin | 15/119.2 |
| 6,061,863 | A | * | 5/2000 | Chen | 15/119.2 |
| 6,217,244 | B1 | * | 4/2001 | Chen et al. | 401/140 |
| RE37,415 | E | * | 10/2001 | Petner | 15/119.2 |
| 6,550,094 | B1 | * | 4/2003 | Hurtado | 15/119.2 |
| 6,785,927 | B2 | * | 9/2004 | Lesley et al. | 15/119.1 |
| 7,178,189 | B1 | * | 2/2007 | Perry et al. | 15/119.2 |
| 7,555,803 | B2 | * | 7/2009 | Libman | 15/119.2 |
| 7,555,804 | B2 | * | 7/2009 | Lin | 15/119.2 |
| 7,624,469 | B2 | * | 12/2009 | Specht et al. | 15/119.2 |
| 7,945,982 | B2 | * | 5/2011 | Hsieh | 15/119.2 |

FOREIGN PATENT DOCUMENTS

| | | | |
|---|---|---|---|
| KR | 20-0201775 | Y1 | 11/2000 |
| KR | 20-0251123 | Y1 | 11/2001 |
| KR | 20-0270908 | Y1 | 4/2002 |

* cited by examiner

SELF-WRINGING MOP

CROSS REFERENCE TO RELATED APPLICATIONS

This application is a national stage filing under 35 U.S.C. 371 of PCT/US2009/032225, filed Jan. 28,2009, which claims priority to China Patent Application No. 200810008772.4, filed Jan. 29,2008, the disclosure of which is incorporated by reference in its/their entirety herein.

BACKGROUND OF THE INVENTION

1. Field of the Invention

The present invention relates to a mop, and particularly to a mop capable of absorbing water from a floor and cleaning the floor.

2. Description of the Related Art

A primary requirement by a customer for a self wringing mop is to absorb water from a floor quickly and completely since the mop is often used in an environment such as a kitchen and a rest room where a lot of water often splashes down. A water absorbing material of the mop is generally made of hydrophilic PVA (polyvinyl alcohol) foam or wood pulp sponge formed by foaming hydrophilic wood pulp fiber.

SUMMARY OF THE INVENTION

In order to overcome at least a part of the above defects existing in the prior art, it is an object of the present invention to provide a mop of which a cleaning portion is capable of rolling and being braked. It is another object of the present application to provide a self-wringing mop.

In accordance with an aspect of the present application, there is provided a mop comprising A mop comprising a handle, a mounting support forming an axis of rotation, wherein the mounting support is connected with the handle, a cleaning portion connected with the mounting support in such a manner that the cleaning portion is rotatable about the axis, and a pressing member connected with the handle, wherein the pressing member engages with the cleaning portion to inhibit rotation of the cleaning portion.

In one embodiment. one of the pressing member and the cleaning portion mounting support are movably connected with the handle so that when the one of the pressing member and the cleaning portion mounting support moves toward the other of the pressing member and the cleaning portion mounting support, the pressing member is brought into contact with an outer periphery of the cleaning portion to set the cleaning portion in a stationary state or a state of rotation with a rotational resistance. With the above configuration, the cleaning portion of the mop can be rolled and braked.

In accordance with another aspect of the present application, the pressing member comprises a first pressing member and a second pressing member with a predetermined space therebetween. The space has a width less than a width of the cleaning portion in a direction perpendicular to the rotation axis of the cleaning portion so that when the one of the pressing member and the mounting support moves toward the other of the pressing member and the mounting support, the first pressing member and the second pressing member are brought into contact with the outer periphery of the cleaning portion, and when the one of the pressing member and the mounting support further moves toward the other of the pressing member and the mounting support, at least a part of the cleaning portion passes through the space formed between the first pressing member and the second pressing member so as to be squeezed of liquids. Each of the first pressing member and the second pressing member may comprise a roller.

In accordance with a further aspect of the present application, the mop further comprises a moving device for moving the one of the pressing member and the mounting support. The moving device includes a lever with an end rotatably connected with the handle, and a link having an end rotatably connected with the one of the pressing member and the mounting support and the other end rotatably connected to a portion of the lever close to the end of the lever so that when the lever is rotated, the one of the pressing member and the mounting support moves.

In accordance with a still another aspect of the present invention, the mop may further comprise a pressing member connecting part including a first pressing member connecting part and a second pressing member connecting part. The first pressing member connecting part and the second pressing member connecting part respectively have ends mounted through a sleeve to the handle, and the other ends respectively connected with the first pressing member and the second pressing member.

In accordance with yet another aspect of the present invention, a space is formed between the first pressing member connecting part and the second pressing member connecting part; and the mounting support includes a first portion extending substantially parallel to the rotation axis of the cleaning portion and located between the first pressing member connecting part and the second pressing member connecting part, second portions respectively extending from two ends of the first portion toward a side of the cleaning portion, and a cleaning portion shaft coupled to ends of the second portions on which the cleaning portion is rotatably mounted. The roller may have a rotation axis substantially parallel to the rotation axis of the cleaning portion.

In accordance with another aspect of the present invention, a locking part is formed on a surface of at least one of the first pressing member connecting part and the second pressing member connecting part, and the surface faces the first portion of the mounting support. A latching part is formed at a portion of the first portion of the mounting support corresponding to the locking part so as to lock the cleaning portion in the stationary state or the state of rotation with a rotational resistance.

BRIEF DESCRIPTION OF THE DRAWINGS

These and/or other aspects and advantages of the present disclosure will become apparent and more readily appreciated from the following description of the embodiments, taken in conjunction with the accompanying drawing.

DETAILED DESCRIPTION OF THE EMBODIMENTS

Figure 1:
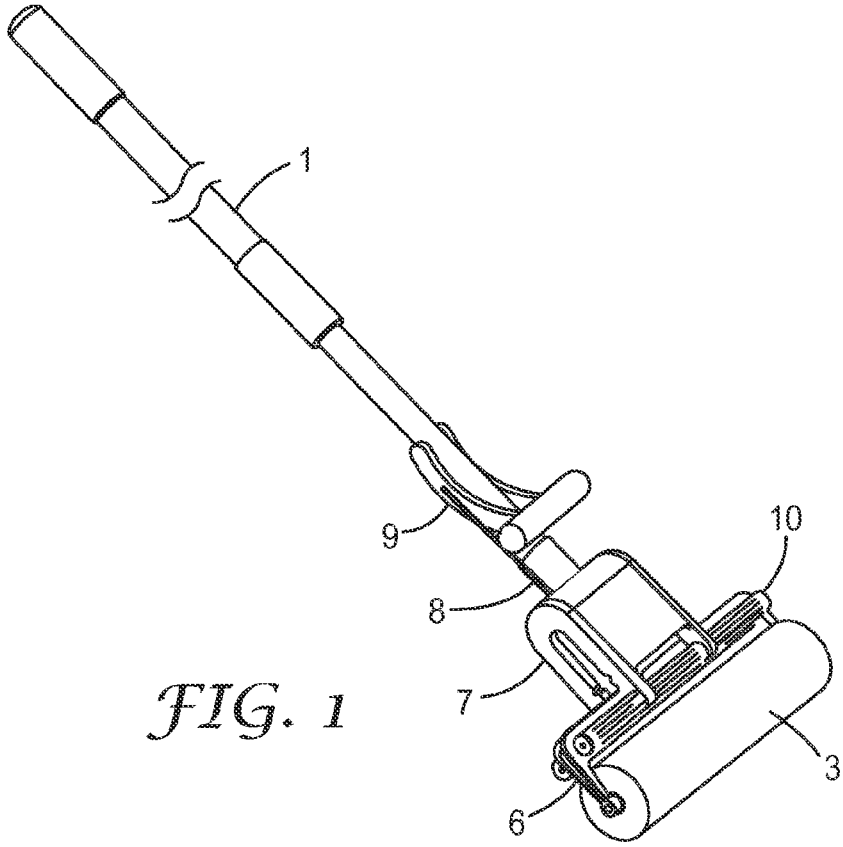
FIG. 1 is a schematic view illustrating the mop of which the cleaning portion is in a state of being capable of freely rotating.
Figure 2:
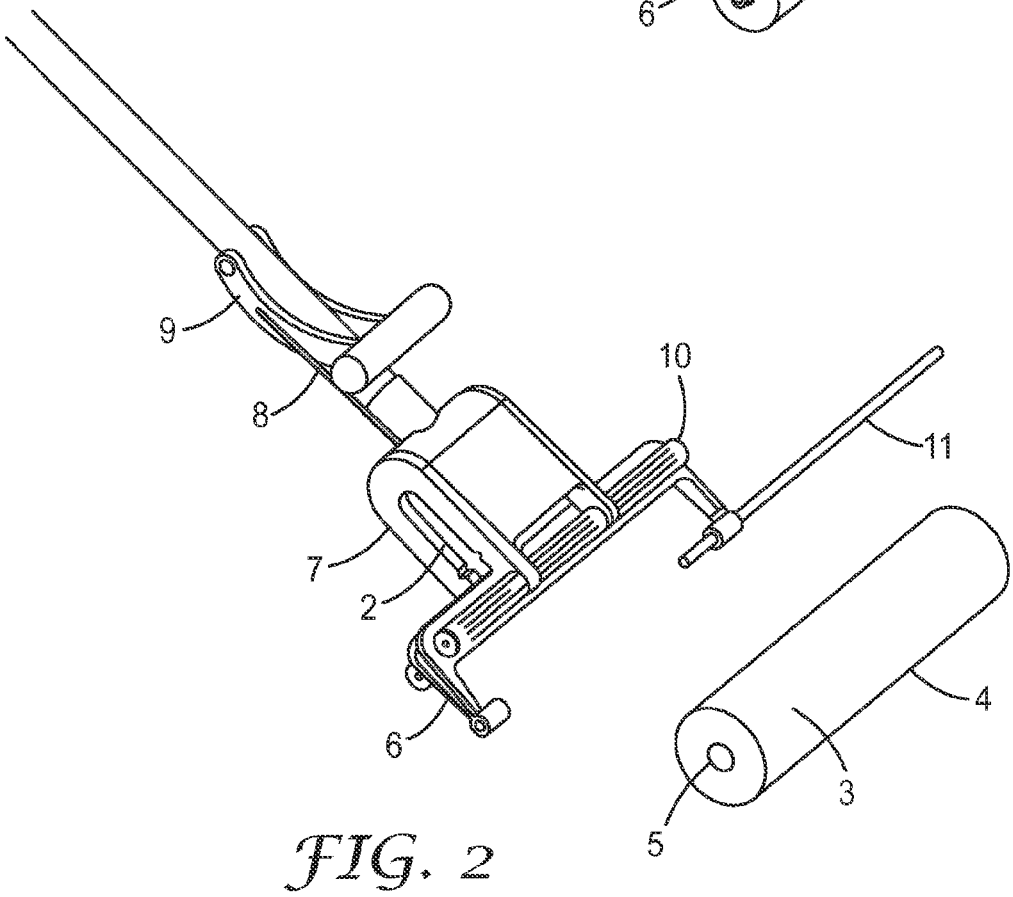
FIG. 2 is a schematic view illustrating the mop of which the cleaning portion has been detached.
Figure 3:
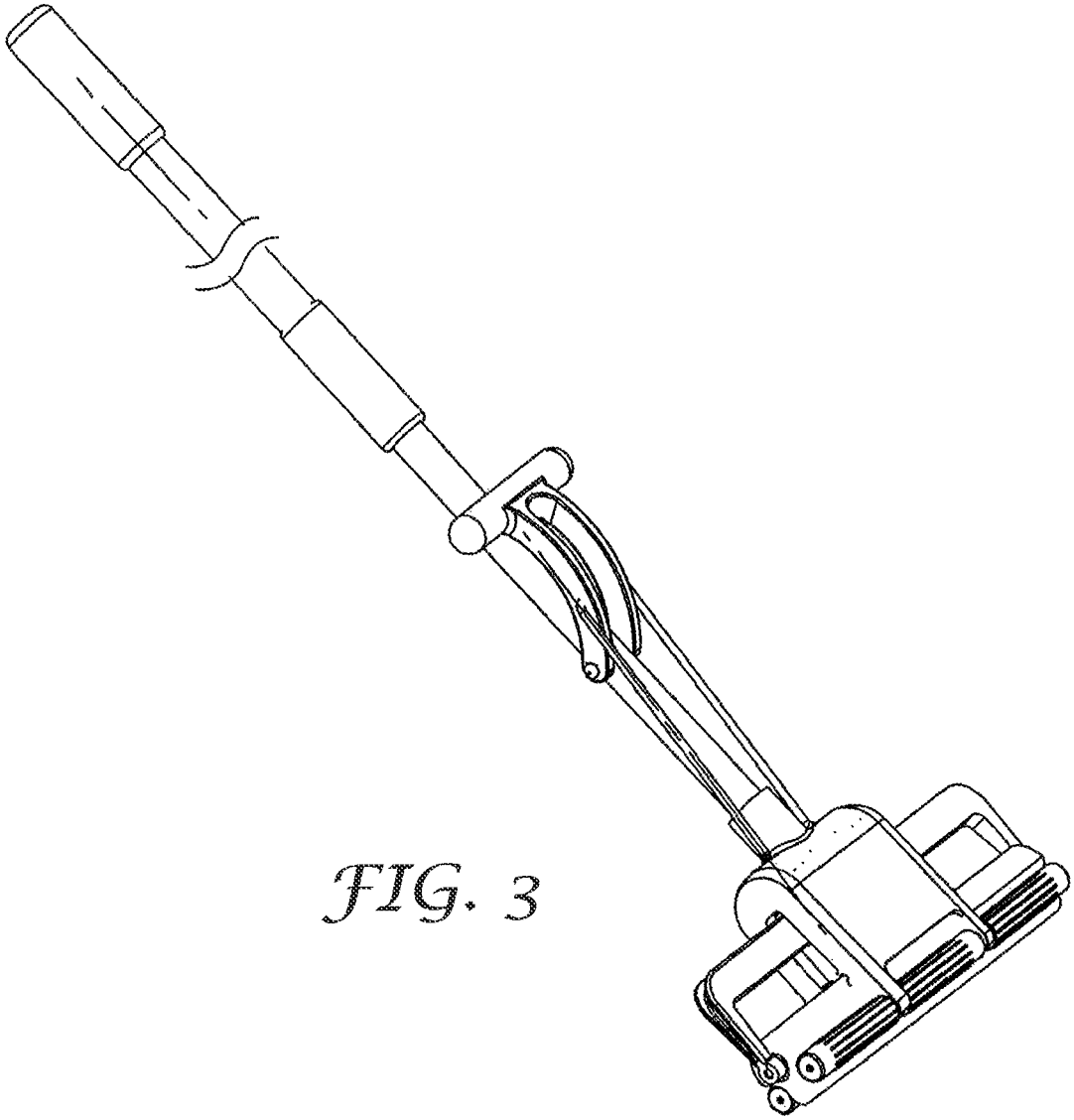
FIG. 3 is a schematic perspective view illustrating the mop of which the cleaning portion of sponge has been squeezed to remove liquid.
Figure 4:
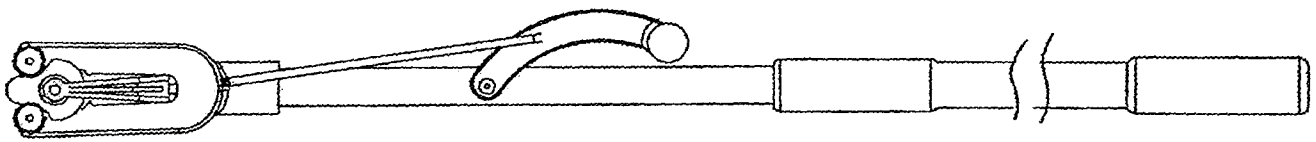
FIG. 4 is a schematic side view illustrating the mop of which the cleaning portion of sponge has been squeezed.

As shown in FIGS. 1-2, the mop comprises: a handle 1; a cleaning portion mounting support 6 connected with the handle 1; a cleaning portion 4 connected with the cleaning portion mounting support 6 in such a manner that the cleaning portion 4 is rotatable about a rotation axis thereof; and a pressing member such as a roller 10 connected with the handle 1. Either the pressing member or the cleaning portion mounting support 6 are movably connected with the handle 1 so that when the one of the pressing member and the cleaning portion mounting support 6 moves (for example, substantially in a longitudinal direction of the handle 1) toward the other of the pressing member and the cleaning portion mounting support 6, the pressing member is brought into contact with an outer periphery of the cleaning portion 4 to set the cleaning portion 4 in a stationary state or a state of rotation with a rotational resistance.

Although the cleaning portion 4 shown in FIGS. 1-8 is configured to be rotatable about the rotation axis thereof, it may be designed to be stationary. In addition, although the cleaning portion 4 shown in FIGS. 1-8 has a shape of a circular cylinder, it may be constructed to have a shape of a cylinder of an oval or elliptical cross section or a shape of a prism of an octagon, hexagon, or pentagon cross section so as to be capable of rotating about an axis thereof to some extent if necessary. In the case of the cleaning portion having a shape of a cylinder of an oval or elliptical section or a shape of a prism of an octagon, hexagon, or pentagon cross section, the cleaning portion can provide a nice scrubbing surface to improve cleaning efficiency when the cleaning portion 4 is stationary or is locked in position. Furthermore, the cleaning portion 4 is not limited to the above shapes, but may have any other appropriate shapes.

In one exemplary embodiment, the pressing member comprises a first pressing member and a second pressing member such as the roller 10 with a predetermined space therebetween. FIGS. 1-2 illustrate a first group of rollers 10 and a second group of rollers 10, as an example of the first pressing member and the second pressing member, which are arranged along two straight lines, respectively. The space has a width less than a width of the cleaning portion 4 in a direction perpendicular to the rotation axis of the cleaning portion so that when the one of the pressing member and the cleaning portion mounting support 6 moves toward the other of the pressing member and the cleaning portion mounting support 6, the first pressing member and the second pressing member are brought into contact with the outer periphery of the cleaning portion 4 to set the cleaning portion 4 in a stationary state or a state of rotation with a rotational resistance, and when the one of the pressing member and the cleaning portion mounting support 6 further moves toward the other of the pressing member and the cleaning portion mounting support 6, at least a part of the cleaning portion 4 passes through the space formed between the first pressing member and the second pressing member so as to be squeezed and remove liquids.

In one exemplary embodiment, each of the first pressing member and the second pressing member may comprise rollers 10 as shown in FIGS. 1-2. Alternatively, each of the first pressing member and the second pressing member may include a part having curved surfaces or planes. The curved surfaces and the planes of the two parts generally correspond to outer peripheries of the rollers. That is, in a cross section of the two parts, the curved surfaces or the planes define a space has a narrow center portion and wide opening portions on both sides of the space so that the cleaning portion 4 can easily pass through the space from one side to the other of the two sides of the space and can be squeezed of liquid by the narrow center portion. In addition, each of the first pressing member and the second pressing member may be constructed to have a shape of a cylinder of an oval or elliptical cross section or a shape of a prism of an octagon, hexagon, or pentagon cross section so as to be capable of rotating. Furthermore, the first pressing member and the second pressing member are not limited to the above shapes and configurations, but may have any other appropriate shapes and configurations.

In another exemplary embodiment, as shown in FIGS. 1-2, the mop further comprises a moving device for moving the one of the pressing member and the cleaning portion mounting support 6. The moving device includes a lever 9 with an end rotatably connected with the handle 1, and a link 8 having an end rotatably connected with either the pressing member or the cleaning portion mounting support 6 and the other end rotatably connected to a portion of the lever 9 close to the end of the lever so that when the lever 9 is rotated, the one of the pressing member and the cleaning portion mounting support 6 moves.

In a further exemplary embodiment, the mop further comprises a pressing member connecting part 7 including a first pressing member connecting part and a second pressing member connecting part. For example, FIGS. 1-2 illustrate a first pressing member connecting part and a second pressing member connecting part that are formed generally in a U shape together with each other. The first pressing member connecting part and the second pressing member connecting part respectively have ends mounted through a sleeve to the handle 1, and the other ends respectively connected with the first pressing member and the second pressing member such as the rollers 10.

In the case where the pressing member is movable with respect to the handle 1 or the cleaning portion mounting support 6, the sleeve to which the pressing member connecting part 7 is fixed is movably connected with the handle 1, and a guide groove (not shown) may be formed in the handle 1, and a guide protrusion (not shown) may be formed in the sleeve so that the pressing member connecting part 7 is guided to move by engagement of the guide groove and guide protrusion. FIGS. 1-8 only illustrate the case where the link 8 is rotatably connected to the cleaning portion mounting support 6, but in the case where the pressing member is movable with respect to the handle 1 or the cleaning portion mounting support 6, the link 8 is rotatably connected to the pressing member or the pressing member connecting part 7.

In the case where each of the first pressing member and the second pressing member includes the part having the curved surfaces or planes, the first pressing member and the second pressing member may be directly connected with the handle 1 rather than through the pressing member connecting part 7. For example, the first pressing member and the second pressing member may include respective connection portions formed integrally therewith for connecting the first pressing member and the second pressing member to the handle 1.

Figure 7:
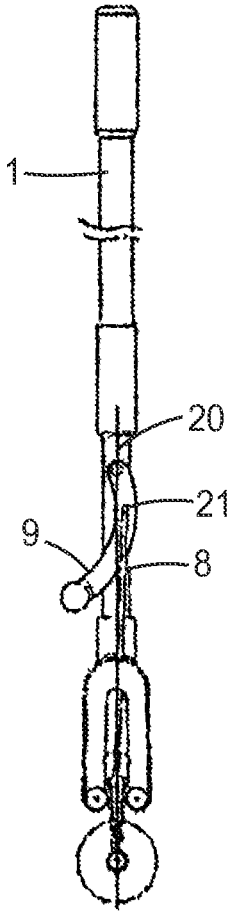
FIG. 7 is a schematic side view illustrating the mop with the rotary cleaning portion.
Figure 8:
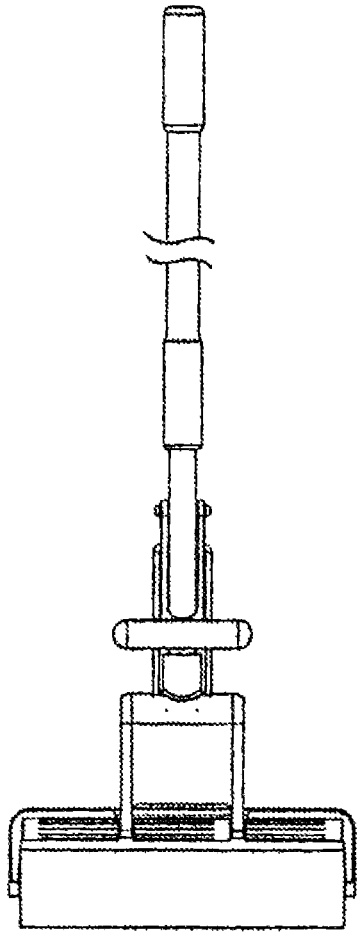
FIG. 8 is a schematic front view illustrating a mop with a rotary cleaning portion.

In one exemplary embodiment, as shown in FIGS. 1, 2 and 7, the first pressing member connecting part and the second pressing member connecting part extend substantially in the longitudinal direction of the handle 1, and a space is formed between the first pressing member connecting part and the second pressing member connecting part. The cleaning portion mounting support 6 includes a first portion extending substantially parallel to the rotation axis of the cleaning portion and located between the first pressing member connecting part and the second pressing member connecting part, second portions respectively extending from two ends of the first portion toward a side of the cleaning portion 4, and a cleaning portion shaft 11 coupled to ends of the second portions on which the cleaning portion 4 is rotatably mounted.

In another exemplary embodiment, as shown in FIGS. 1-2, the cleaning portion mounting support 6 further includes a guide rod (not shown) connected with the first portion of the cleaning portion mounting support 6 and the handle 1 has a hollow chamber (not shown) into which the guide rod is inserted. The guide rod may be fixed to the handle 1 or connected with the handle 1 in such a manner that the guide rod is movable with respect to the handle 1. In the case that the guide rod is movably connected with the handle 1, a groove (not shown) may be formed in the guide rod in a longitudinal direction. The guide rod is prevented from rotating with respect to the handle 1 but allowed to move in the longitudinal direction of the handle 1 by positing in the groove a pin for connecting the lever 9 to the handle 1.

In another exemplary embodiment, each of the rollers 10 may have a rotation axis substantially parallel to the rotation axis of the cleaning portion 4. However, the present invention is not limited to that, and the rotation axis of each of the roller 10 and the rotation axis of the cleaning portion 4 may be appropriately oriented with respect to each other so long as the cleaning portion 4 can be braked and dewatered by the rollers 10.

Figure 6:
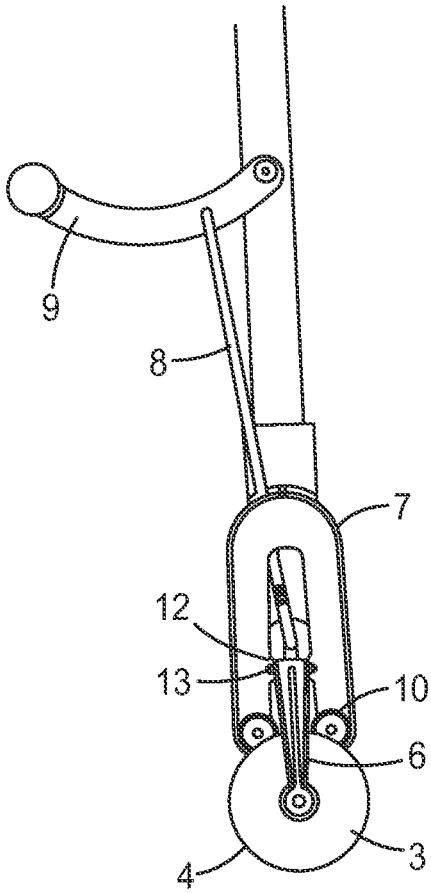
FIG. 6 is a schematic side view illustrating the mop of which the cleaning portion of sponge has been braked.

In a further exemplary embodiment, a locking part is formed on a surface of at least one of the first pressing member connecting part and the second pressing member connecting part, and the surface faces the first portion of the cleaning portion mounting support 6. A latching part is formed at a portion of the first portion of the cleaning portion mounting support 6 corresponding to the locking part so as to lock the cleaning portion 4 in the stationary state or the state of rotation with a rotational resistance. In addition, the cleaning portion 4 may be locked in a state of free rotation in the same manner. For example, as shown in FIG. 6, recesses 12 as an example of the locking part are formed in projections disposed on the opposite inner surfaces of the U-shaped pressing member connecting part 7, while protrusions 13 as an example of the latching part are disposed on the first portion of the cleaning portion mounting support 6.

In the exemplary embodiment shown in FIGS. 1-8, the cleaning portion 4 is squeezed to remove liquid by a labor-saving linkage mechanism composed of the cleaning portion mounting support 6, the link 8 and the lever 9, and a roller water squeezing device composed of the pressing member connecting part 7 and the rollers 10. A user can grip and rotate the lever 9 to drive the U-shaped cleaning portion mounting support 6 to move up and down. The U-shaped cleaning portion mounting support 6 is used to mount a replaceable sponge roller 3 of the cleaning portion 4. In use, a user can rotate the lever 9 so as to drive the cleaning portion 4 to pass through the space between the two rows of rollers 10. As a result, the sponge roller 3 is squeezed dry. In addition, the U-shaped cleaning portion mounting support 6 can slide up and down in a guide slide groove 2 formed within the U-shaped pressing member connecting part 7. The two rows of rotatable rollers 10 are fixed at edges of the U-shaped pressing member connecting part 7 at a lower end of the guide slide groove 2. Since the space between the two rows of the rollers 10 is less than an outer diameter of the sponge roller 3 in an undeformed state, and a distance between the two rows of the rollers 10 is nearly constant, when the sponge roller 3 is forced to pass through the space between the two rows of the rollers 10, the sponge roller 3 is squeezed by the two rows of the rollers 10 so that water absorbed by the sponge roller 3 is removed.

The sponge roller 3 may be formed from a variety of materials that are water absorbent. In one example, synthetic foam such as urethane foam may be used. In another example, the sponge roller 3 may be formed of a cellulose sponge. Other absorbent woven, knitted, or nonwoven materials made from natural, synthetic, or a combination of natural and synthetic fibers may be used on the sponge roller 3. Further, all or a portion of the sponge roller 3 may include a scouring surface. Examples of scouring surface may be brushes, bristles, nonwoven (similar to a Scotch-Brite® scouring pad, available from 3M Company of St. Paul Minn.). For example, the sponge roller may include one or more stripes of a scouring material directly on the roller. As discussed, when the sponge roller 3 is in a locked position, then the scouring surface may enhance the ability to remove dirt from the surface being cleaned.

The handle 1 is a straight rod of which an upper end portion can be used as a hand grip for a user to grip. The straight rod has two rods to form a telescopic straight rod. A user can adjust a length of the straight rod within a certain range according to requirement.

The cleaning portion 4 as a high-efficiency water absorbing tool comprises the circular cylindrical sponge roller 3 and a hard pipe core 5 and can freely rotate. In use, a user can grip the handle 1 and move the handle 1 back and forth so that the cleaning portion 4 rolls back and forth on a surface from which water is to be removed. The water is absorbed quickly from the surface. As schematically shown in FIG. 7, the lever 9 is provided at an upper portion with a rotation axis 21, that is, an axis of a pin for connecting the link 8 with the lever 9. The rotation axis 21 is designed to be spaced away from a straight line 20. The straight line 20 extends in the longitudinal direction of the handle and intersects an axis of the pin for connecting the lever 9 to the handle 1. In the state shown in FIG. 7, the lever 9 rotates to a lower angular limit and is stopped by the handle 1. With the above configuration, it is assured that the cleaning portion 4 will not be upward moved due to a pushing force applied thereto by the surface, from which water is to be removed, during removing water from the surface so long as the user does not rotate the lever 9 upward. Otherwise, the rollers 10 will be brought into contact with the sponge roller 3 of the cleaning portion 4. Therefore, the sponge roller 3 of the cleaning portion 4 is braked so as to affect the rolling of the sponge roller 3 and thus water-absorbing effect of the sponge roller 3.

When the sponge roller 3 is to be replaced, as shown in FIG. 2, the hard pipe core 5 at a center of the cleaning portion 4 can be conveniently engaged to the cleaning portion mounting support 6, and at the same time, the shaft 11 can pass through the hard pipe core 5 and be locked by inserting the shaft 11 into a hole of the cleaning portion mounting support 6 and the hard pipe core 5 from a side of the U-shaped cleaning portion mounting support 6 in assembling. As a result, it is assured to mount the cleaning portion 4 securely to the U-shaped cleaning portion mounting support 6.

Figure 5:
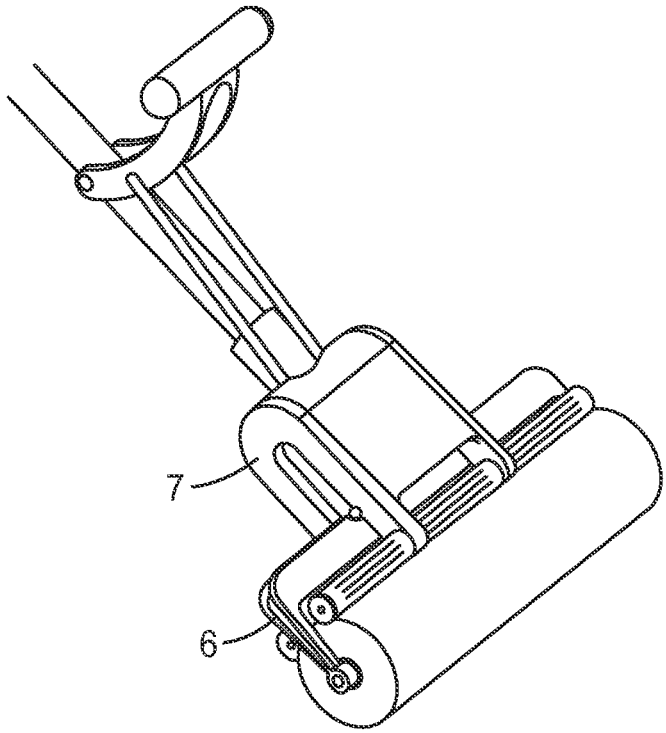
FIG. 5 is a schematic perspective view illustrating the mop of which the cleaning portion of sponge has been braked.

In order to clean dirt effectively from a surface, as shown in FIGS. 5 and 6, the lever 9 is slightly rotated upward to drive the U-shaped cleaning portion mounting support 6 connected with the cleaning portion 4 to slide upward along inner walls of the guide groove 2. When the cleaning portion 4 moves to be brought into contact with the rollers 10 and is subjected to a pressure and the sponge roller 3 is braked so that it can not freely rotate, the recesses 12 and protrusions 13 respectively disposed at the surfaces, which are in contact with each other, of the U-shaped pressing member connecting part 7 and the guide groove 2 engage with each other by mutual pushing of the U-shaped pressing member connecting part 7 and the U-shaped cleaning portion mounting support 6 and by means of elasticity of the U-shaped pressing member connecting part 7 and the U-shaped cleaning portion mounting support 6 made of plastic. As a result, the roller 3 is set in a stationary sate. In this state, since the sponge roller 3 can only slip but can not roll on the surface to be cleaned, effective scouring or scrubbing can be accomplished by the sponge roller 3. In addition, a plurality of the recesses 12 and protrusions 13 may be disposed to lock the cleaning portion 4 in the free rotation sate, the stationary sate or the state of rotation with a rotational resistance.

The invention claimed is:

1. A mop comprising:

a handle;

a mounting support forming an axis of rotation, wherein the mounting support is connected with the handle;

a cleaning portion connected with the mounting support in such a manner that the cleaning portion is rotatable about the axis; and a pressing member connected with the handle;

wherein the mop is configured to transition between:

a state of free rotation in which the cleaning portion is permitted to freely rotate, and a state of inhibited rotation in which the pressing member engages with the cleaning portion to inhibit rotation of the cleaning portion, wherein the pressing member comprises a first pressing member and a second pressing member with a predetermined space therebetween, the space having a width less than a width of the cleaning portion in a direction perpendicular to the rotation axis of the cleaning portion, and wherein the pressing member further includes a pressing member connecting part including a first pressing member connecting part and a second pressing member connecting part, the first and second pressing member connecting parts each having a first end connected to the handle and a second end connected with a respective one of the first and second pressing members, and further wherein a locking part is formed on a surface of at least one of the first pressing member connecting part and the second pressing member connecting part, the surface facing the first portion of the cleaning portion mounting support; and a latching part is formed at a portion of the first portion of the cleaning portion mounting support corresponding to the locking part so as to lock the cleaning portion in the state of inhibited rotation.

2. The mop of claim 1, wherein the pressing member is movably connected with the handle for engaging the pressing member with the cleaning portion.

3. The mop of claim 1, wherein the mounting support is movably connected with the handle for engaging the pressing member with the cleaning portion.

4. The mop of claim 1, wherein the pressing member engages against the periphery of the cleaning portion.

5. The mop of claim 1, wherein the pressing member engages across the entire cleaning portion.

6. The mop according to claim 1, wherein each of the first pressing member and the second pressing member comprises a roller.

7. The mop according to claim 1 wherein the first ends of the first pressing member connecting part and the second pressing member connecting part respectively are mounted through a sleeve to the handle.

8. The mop according to claim 7, wherein:

a space is formed between the first pressing member connecting part and the second pressing member connecting part; and the mounting support includes a first portion extending substantially parallel to the rotation axis of the cleaning portion and located between the first pressing member connecting part and the second pressing member connecting part, second portions respectively extending from two ends of the first portion toward a side of the cleaning portion, and a cleaning portion shaft coupled to ends of the second portions on which the cleaning portion is rotatably mounted.

9. The mop according to claim 1, wherein the latching part and the locking part are configured such upon engagement between the latching part and the locking part, the latching part and the locking part prevent:

movement of the cleaning portion and the pressing members toward one another; and movement of the cleaning portion and the pressing members away from one another.

10. The mop according to claim 1, wherein the mop is configured to transition a relationship of the pressing member relative to the cleaning member between:

the state of free rotation in which an entirety of the cleaning portion is forward of the pressing member such that the cleaning portion freely rotates;

the state of inhibited rotation in which the axis of rotation is forward of the pressing member and the pressing member engages with the cleaning portion to inhibit rotation of the cleaning portion; and a state of liquid removal in which the axis of rotation is rearward of the pressing member, wherein transition from the state of inhibited rotation to the state of liquid removal includes the pressing member pressing against the cleaning portion to remove liquid contained in the cleaning portion.

11. The mop according to claim 10, further comprising:

a lever rotatably coupled to the handle; and a link extending between and connected to the lever and the mounting support;

wherein the link transfers movement of the lever to the mounting support in transitioning the mop between the states of free rotation, inhibited rotation, and liquid removal;

and further wherein an entirety of the link is located outside of the handle.

12. The mop according to claim 10, further comprising a lever rotatably coupled to the handle, wherein coupling of the lever permits rotation of the lever relative to the handle between:

a lower angular limit corresponding with the state of free rotation; and an upper angular limit corresponding with the state of liquid removal;

wherein the cleaning portion remains connected with the mounting support, and the mounting support remains connected with the handle at the lower angular limit and the upper angular limit.

13. The mop according to claim 10, wherein the cleaning portion is a circular cylinder sponge.

* * * * *

UNITED STATES PATENT AND TRADEMARK OFFICE

CERTIFICATE OF CORRECTION

PATENT NO. : 8,522,388 B2
APPLICATION NO. : 12/865179
DATED : September 3, 2013
INVENTOR(S) : Weilai Jiang It is certified that error appears in the above-identified patent and that said Letters Patent is hereby corrected as shown below:

In the Specification

Column 1

| | |
|---|---|
| Line 7 | Delete "28,2009," and insert -- 28, 2009, --, therefor. |
| Line 9 | Delete "28,2009," and insert -- 28, 2009, --, therefor. |

Column 7

| | |
|---|---|
| Line 8 | Delete "sate." and insert -- state. --, therefor. |
| Line 13 | Delete "sate," and insert -- state, --, therefor. |
| Line 13 | Delete "sate" and insert -- state --, therefor. |

Signed and Sealed this
Fourth Day of February, 2014

Michelle K. Lee

Michelle K. Lee
*Deputy Director of the United States Patent and Trademark Office*